US011713583B2

(12) United States Patent
Friedman

(10) Patent No.: US 11,713,583 B2
(45) Date of Patent: Aug. 1, 2023

(54) HOTEL ROOM

(71) Applicant: RH US, LLC, Corte Madera, CA (US)

(72) Inventor: Gary Friedman, Belvedere, CA (US)

(73) Assignee: RH US, LLC, Corte Madera, CA (US)

( * ) Notice: Subject to any disclaimer, the term of this patent is extended or adjusted under 35 U.S.C. 154(b) by 62 days.

(21) Appl. No.: 17/091,930

(22) Filed: Nov. 6, 2020

(65) Prior Publication Data

US 2022/0145651 A1 May 12, 2022

(51) Int. Cl.

| | |
|---|---|
| ***E04H 3/02*** | (2006.01) |
| *E04H 1/02* | (2006.01) |
| *E04H 3/08* | (2006.01) |
| *E04H 3/10* | (2006.01) |

(52) U.S. Cl.

CPC ..... *E04H 3/02* (2013.01); *E04H 1/02* (2013.01); *E04H 3/08* (2013.01); *E04H 3/10* (2013.01)

(58) Field of Classification Search

CPC .... E04H 3/02; E04H 3/14; E04H 1/04; E04B 2/96

See application file for complete search history.

(56) References Cited

U.S. PATENT DOCUMENTS 3,866,548 A * 2/1975 Skonieczny ..... A47B 5/06 5/3
3,952,465 A * 4/1976 Masiello ..... E04B 1/34861 52/234
4,130,070 A * 12/1978 Herrin ..... A47B 13/081 108/143
4,306,388 A * 12/1981 Yuter ..... H04R 27/00 186/35
5,088,135 A * 2/1992 Violette ..... B60P 3/36 5/8
5,197,776 A * 3/1993 Brown ..... B60P 3/38 296/65.03
6,296,314 B1 * 10/2001 Klein ..... A47B 85/04 297/440.14
6,691,475 B1 * 2/2004 Tiongco ..... E04H 3/02 52/234
7,399,031 B2 * 7/2008 Gardner ..... B60P 3/36 297/118
8,141,304 B2 3/2012 Shen et al.
9,493,940 B2 11/2016 Collins et al.
9,907,404 B1 * 3/2018 Sorel ..... A47C 7/68
2005/0108957 A1 * 5/2005 Quesada ..... E04B 1/34869 52/143

(Continued)

OTHER PUBLICATIONS

L'Hotel Quebec, bathroom layout. User uploaded picture. Sep. 2018.*

(Continued)

*Primary Examiner* — Paola Agudelo
(74) *Attorney, Agent, or Firm* — Lewis Roca Rothgerber Christie LLP

(57) ABSTRACT

A hotel room includes a series of exterior walls surrounding an interior space, a doorway in a front exterior wall of the series of exterior walls, a vestibule extending from the doorway into the interior space, and first and second bathrooms in the interior space on opposite sides of the vestibule. The configuration of the first bathroom is the same as the configuration of the second bathroom, and the doorway is centered along the front exterior wall.

19 Claims, 4 Drawing Sheets

(56) References Cited

U.S. PATENT DOCUMENTS

| | | | | |
|---|---|---|---|---|
| 2007/0074471 | A1* | 4/2007 | Gallagher | E04H 3/02 52/236.3 |
| 2008/0282630 | A1* | 11/2008 | Fukui | E04H 3/02 52/234 |
| 2009/0184612 | A1* | 7/2009 | McClure | A47B 83/00 297/188.03 |
| 2009/0249982 | A1* | 10/2009 | Palethorpe | A47B 5/00 108/44 |
| 2013/0335336 | A1* | 12/2013 | Esparza | G06Q 10/02 345/173 |
| 2014/0096461 | A1* | 4/2014 | McLoughlin | E04H 3/02 52/234 |
| 2017/0175409 | A1* | 6/2017 | Canavati | E04H 3/22 |
| 2017/0224120 | A1* | 8/2017 | Georgiadis | F41H 5/08 |
| 2018/0230692 | A1* | 8/2018 | Thebaud | E04H 1/04 |
| 2019/0335899 | A1* | 11/2019 | Langbert | A47B 67/005 |
| 2020/0219346 | A1* | 7/2020 | Dhannawat | G07C 9/00571 |

OTHER PUBLICATIONS

Harbor Village Appartments—Executive 2 bedroom model built in 1984 https://www.apartments.com/harbor-village-apartments-costa-mesa-ca/504fewm/.*

Extended European Search Report for Application No. 21206791,2, dated Apr. 13, 2022, 6 pages.

Anonymous: "Gipfelsuite 120m2—SPA-Hotel DAS Schafer 4 Doppelzimmer, 2 Balkone", Aug. 11, 2020 (Aug. 11, 2020), XP055904834, Retrieved from the Internet: URL:https://web.archive.org/web/20200811121150/https://dasschaefer.at/zimmer/gipfelsuite/ [retrieved on Mar. 24, 2022].

Anonymous: "Las Vegas Two Bedroom City Suite I the Cosmopolitan", Oct. 23, 2020 (Oct. 23, 2020), XP55906203, Retrieved from the Internet: URL:https://web.archive.org/web/20201023103155/https://www.cosmopolitanlasvegas.com/resort/rooms-suites/two-bedroom-city-suite [retrieved on Mar. 29, 2022].

* cited by examiner

HOTEL ROOM

BACKGROUND

1. Field

The present disclosure relates generally to hotel room layouts.

2. Description of Related Art

Hotel rooms have a variety of different configurations and a variety of different layouts of the furniture and the fixtures therein. However, many conventional hotel rooms include only a single bathroom, which reduces privacy and may increase the time it takes the occupants to get ready in the morning when two or more persons are staying in the hotel room. Additionally, many conventional hotel rooms include asymmetric layouts and/or may include any arrangement of the fixtures and/or the furniture that obstructs the guest's view out of one or more of the windows in the hotel room.

SUMMARY

The present disclosure is directed to various embodiments of a hotel room. In one embodiment, the hotel room includes a series of exterior walls surrounding an interior space, a doorway in a front exterior wall of the series of exterior walls, a vestibule extending from the doorway into the interior space, and first and second bathrooms in the interior space on opposite sides of the vestibule. A configuration of the first bathroom is the same as a configuration of the second bathroom, and the doorway is centered along the front exterior wall.

The first bathroom may be a mirror of the second bathroom about a centerline of the vestibule.

Each of the first and second bathrooms may include a rear interior wall, an interior sidewall, a space defined between the rear interior wall, the interior sidewall, a portion of the front exterior wall, and a portion of an exterior sidewall of the plurality of exterior walls, a sink in the space and along the rear interior wall, a toilet in the space and along the front exterior wall, and a shower in the space and along the exterior sidewall.

Each of the first and second bathrooms may include an entryway in the interior sidewall that opens to the vestibule.

The hotel room may also include a common area in the interior space. The vestibule opens up into the common area.

The hotel room may also include a bed in the common area.

The bed may be laterally centered in the common area between a pair of opposing exterior sidewalls of the series of exterior walls.

The bed may include a frame and a headboard, and a back surface of the headboard faces the vestibule.

The hotel room may also include a series of windows in a rear exterior wall of the series of exterior walls, and a height of the headboard may be substantially equal to a height of a window sill of a central window of the series of windows.

Upper corners of the headboard may be rounded.

The hotel room may also include a first built-in corner banquette seat in a first corner of the common area proximate to a rear exterior wall of the series of exterior walls opposite the front exterior wall, and a second built-in corner banquette seat in a second corner of the common area proximate to the rear exterior wall.

The hotel room may also include a first closet along a rear interior wall of the first bathroom, and a second closet along a rear interior wall of the second bathroom.

The hotel room may include a first armoire along a first exterior sidewall of the series of exterior walls, and a second armoire along a second exterior sidewall of the series of exterior walls opposite the first exterior sidewall.

The hotel room may include a first built-in banquette seat extending along the first exterior sidewall between the first armoire and the first closet, and a second built-in banquette seat extending along the second exterior sidewall between the second armoire and the second closet.

The hotel room may also include a banquette table along the rear exterior wall between the first and second built-in corner banquette seats.

The hotel room may further include a pair of banquette table seats facing the banquette table.

In another embodiment, the hotel room includes a series of exterior walls surrounding an interior space, a doorway in a front exterior wall of the series of exterior walls, a vestibule extending from the doorway into the interior space, first and second bathrooms in the interior space on opposite sides of the vestibule, a common area at an end of the vestibule, a single bed including a frame and a headboard in the common area, and a series of windows in a rear exterior wall of the series of exterior walls. A rear surface of the headboard faces the vestibule.

The hotel may also include first and second closets along rear interior walls of the first and second bathrooms, first and second armoires along first and second exterior sidewalls of the series of exterior sidewalls, first and second built-in banquette seats extending along the first and second exterior sidewalls between a respective one of the first and second armoires and a respective one of the first and second closets, first and second built-in corner banquette seats in first and second corners of the common area proximate to a rear exterior wall of the series of exterior walls opposite the front exterior wall, a banquette table along the rear exterior wall between the first and second built-in corner banquette seats, and first and second banquette table seats facing the banquette table.

The first and second closets, the first and second armoires, the first and second built-in banquette seats, the first and second built-in corner banquette seats, the banquette table, and first and second banquette table seats together extend continuously around a perimeter of the common area except at the vestibule.

A configuration of the first bathroom may be the same as a configuration of the second bathroom, and the doorway may be centered along the front exterior wall.

This summary is provided to introduce a selection of features and concepts of embodiments of the present disclosure that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

Figure 1:
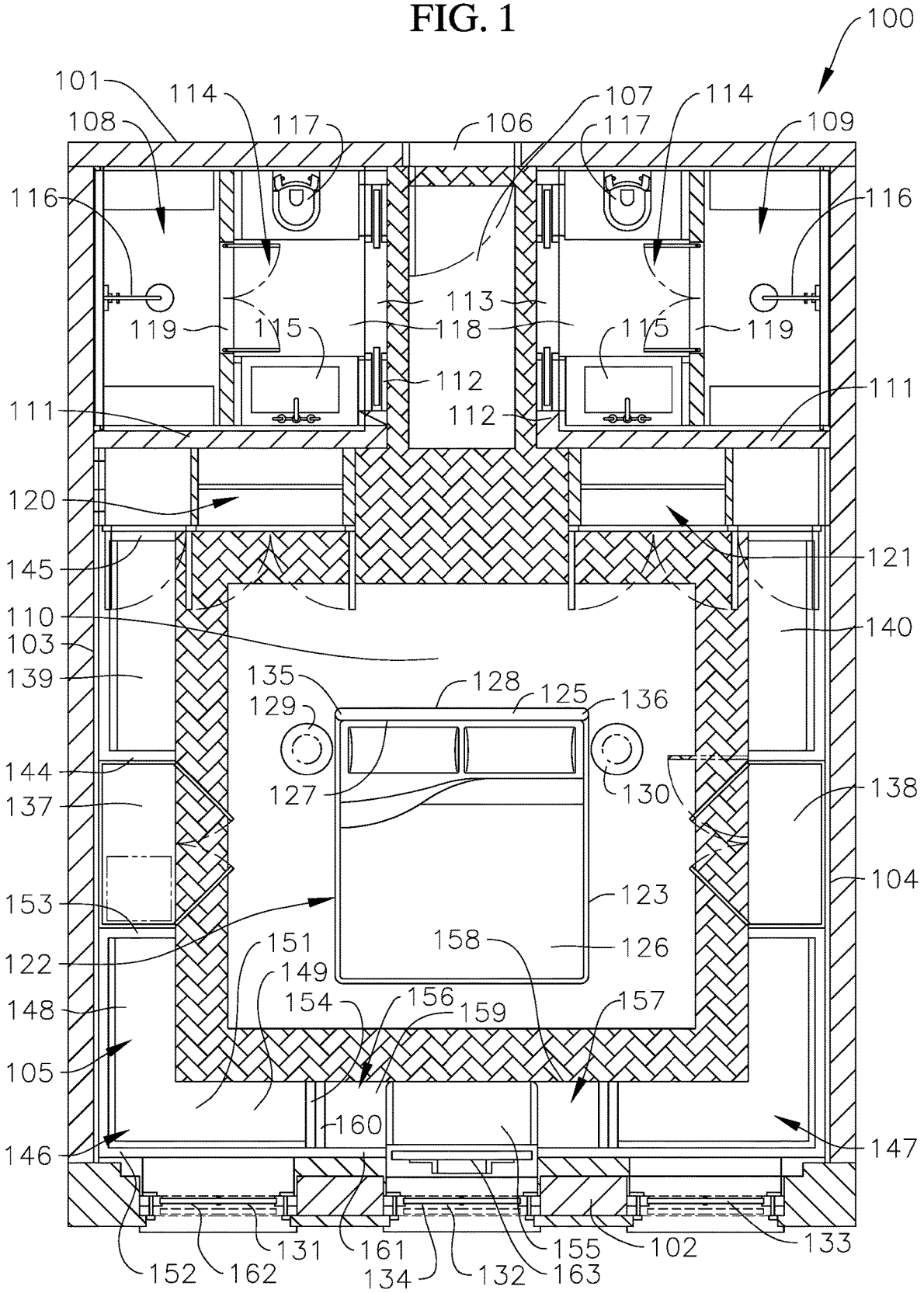
FIG. 1 is a schematic layout of a hotel room according to one embodiment of the present disclosure.

The present disclosure is directed to various embodiments of a hotel room 100. In the illustrated embodiment, the hotel room 100 includes a series of exterior walls 101, 102, 103, 104 defining an interior space 105, a doorway 106 in a front exterior wall 101 connecting the interior space 105 to an exterior of the hotel room 100 (e.g., a hallway), a vestibule 107 extending from the doorway 106 into the interior space 105, a pair of bathrooms 108, 109 on opposite sides of the vestibule 107, and a common area 110. In the illustrated embodiment, the common area 110 is at an end of the vestibule 107 opposite the doorway 106 (e.g., the interior end of the vestibule 107 opens up into the common area 110 of the hotel room 100).

Providing the pair of bathrooms 108, 109 enables, for example, a couple staying in the hotel room 100 to use separate bathrooms 108, 109 simultaneously, which maintains each individual's privacy. Additionally, in one or more embodiments in which the bathrooms 108, 109 have the same configuration as each other, the pair of bathrooms 108, 109 enables a couple staying in the hotel room 100 to use the same bathroom fixture (e.g., the shower, the toilet, or the vanity) at the same time, which may reduce the time it takes the occupants of the hotel room 100 to get ready compared to a conventional hotel room including only a single bathroom.

In the illustrated embodiment, the hotel room 100 includes four exterior walls 101, 102, 103, 104 arranged in a rectangular configuration (e.g., a pair of opposing exterior sidewalls 103, 104 and a pair of opposing front and rear exterior walls 101, 102 at opposite ends of the exterior sidewalls 103, 104) such that the interior space 105 of the hotel room 100 is rectangular. In one or more embodiments, hotel room 100 may include any other suitable number of walls and the walls may be arranged in any other suitable configuration, depending, for instance, on the configuration of the hotel in which the hotel room 100 is located and/or the location of the hotel room 100 within the hotel.

In the illustrated embodiment, each of the bathrooms 108, 109 includes a rear interior wall 111 extending into the interior space 105 from one of the exterior sidewalls 103, 104 toward the opposing exterior sidewall 103, 104, an interior sidewall 112 adjoining the rear interior wall 111 and extending into the interior space 105 from the front exterior wall 101 toward the rear exterior wall 102, and an entryway 113 (e.g., a pocket door) in the interior sidewall 112 that provides access to an interior space 114 of the bathroom 108, 109. In the illustrated embodiment, the interior space 114 of each of the bathrooms 108, 109 is defined by a corner of the hotel room 100 (e.g., a portion of the front exterior wall 101 and a portion of one of the exterior sidewalls 103, 104 adjacent to the front exterior wall 101), the rear interior wall 111 of the bathroom 108, 109, and the interior sidewall 112 of the bathroom 108, 109. Accordingly, in the illustrated embodiment, the bathrooms 108, 109 are located in the front corners of the hotel room 100 proximate to the front exterior wall 101 of the hotel room 100.

In the illustrated embodiment, the doorway 106 and the vestibule 107 are centered or substantially centered along the front exterior wall 101 of the hotel room 100. Additionally, in the illustrated embodiment, the vestibule 107 extends perpendicular or substantially perpendicular to the front exterior wall 101 and extends parallel or substantially parallel to the exterior sidewalls 103, 104 of the hotel room 100. In the illustrated embodiment, the vestibule 107 extends between the two bathrooms 108, 109 (e.g., the vestibule 107 extends along the interior sidewalls 112 of the bathrooms 108, 109). Additionally, in the illustrated embodiment, the entryways 113 of the bathrooms 108, 109 open up into the vestibule 107 such that the bathrooms 108, 109 are accessible from the vestibule 107.

In the illustrated embodiment, the rear interior wall 111 of each of the bathrooms 108, 109 is parallel or substantially parallel to the front exterior wall 101 of the hotel room 100, the interior sidewall 112 of each of the bathrooms 108, 109 is parallel or substantially parallel to one of the exterior sidewalls 103, 104 of the hotel room 100, and the rear interior wall 111 of each of the bathrooms 108, 109 is parallel or substantially parallel to the respective interior sidewall 112 of the bathroom 108, 109. Accordingly, in the illustrated embodiment, each of the bathrooms 108, 109 has a generally square shape. In one or more embodiments, the bathrooms 108, 109 may have any other suitable configuration (e.g., shape and orientation).

Figure 2:
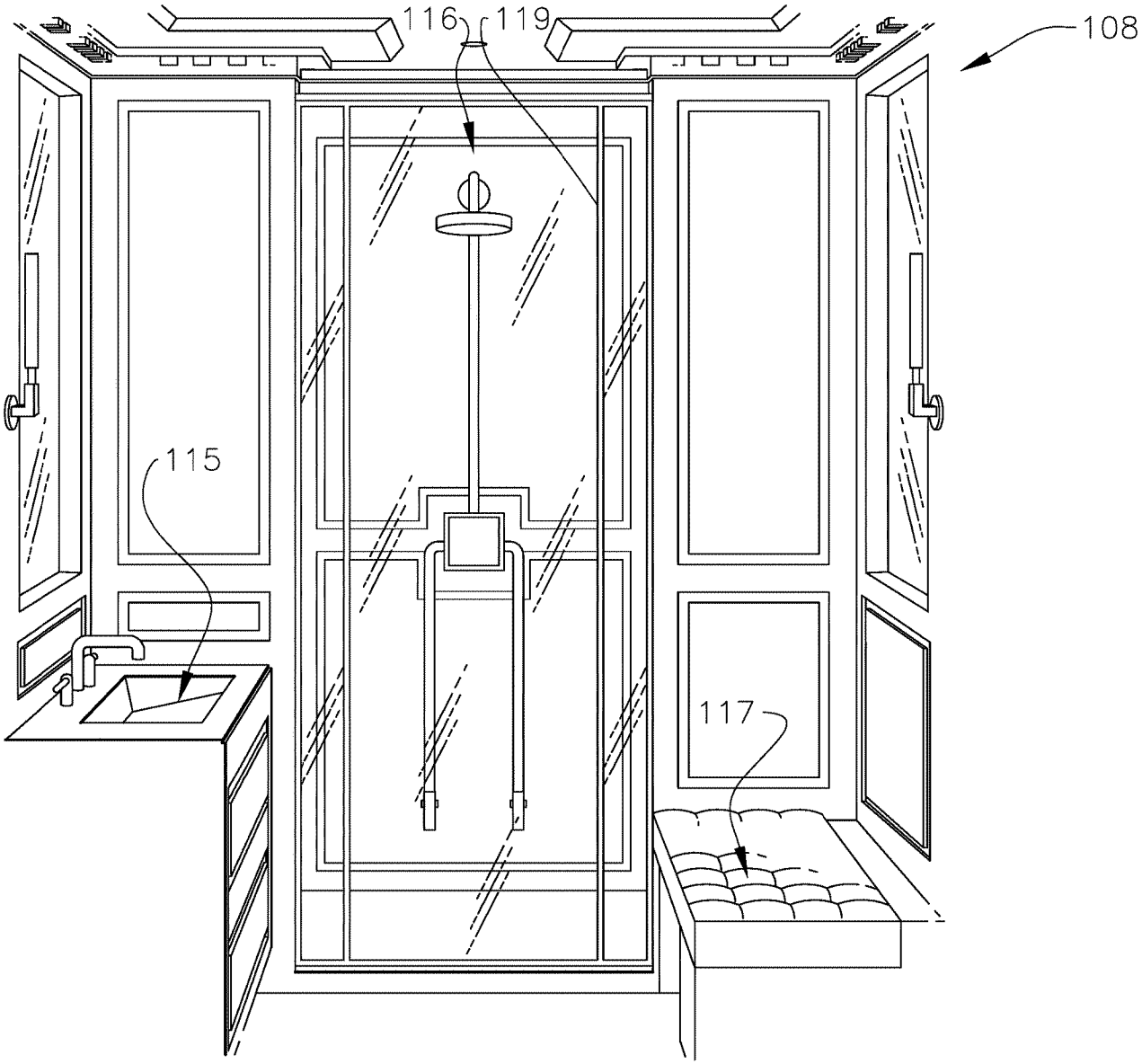
FIG. 2 is a view of a bathroom of the hotel room according to one embodiment of the present disclosure.
Figure 3A:
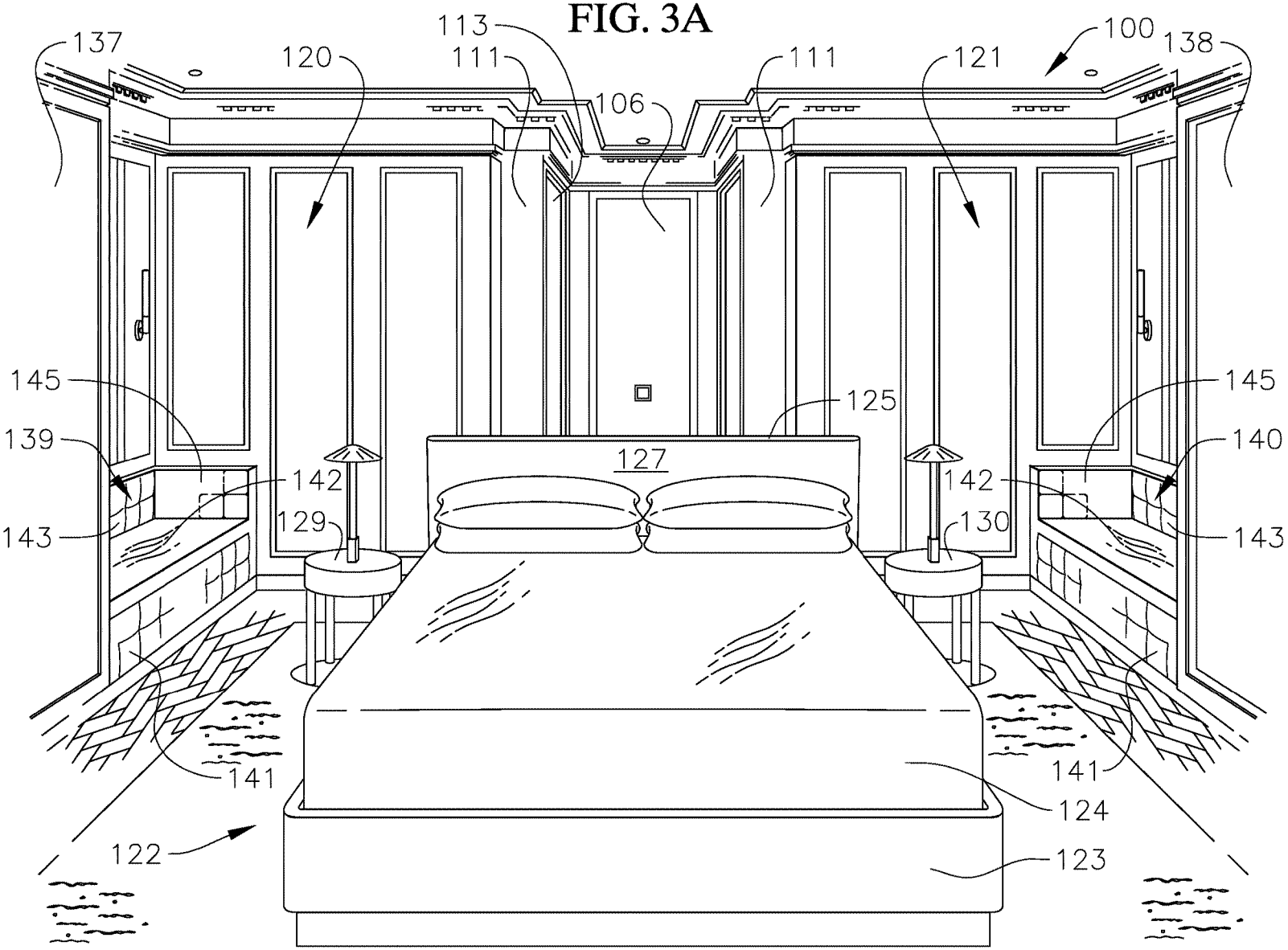
FIGS. 3A-3B are a front-facing view and a rear-facing view, respectively, of the hotel room according to one embodiment of the present disclosure.
Figure 3B:
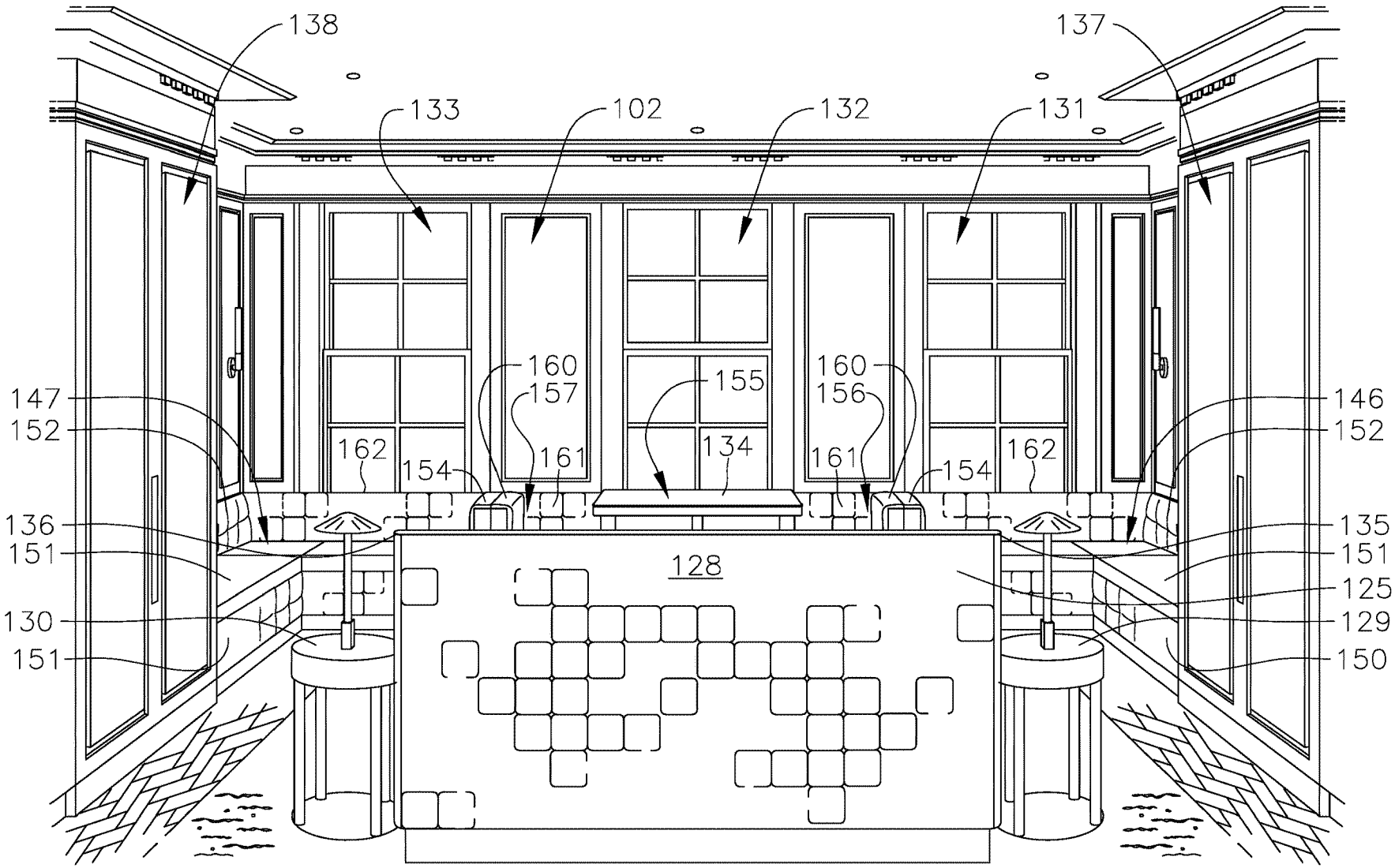

With reference now to the embodiment illustrated in FIG. 2, the interior space 114 of each of the bathrooms 108, 109 includes a vanity having a sink 115, a shower 116, and a toilet 117. In the illustrated embodiment, the sink 115 is along the rear interior wall 111 of the bathroom 108, 109, the toilet 117 is along the front exterior wall 101 of the hotel room 100, and the shower 116 is along one of the exterior sidewalls 103, 104 of the hotel room 100. Additionally, in the illustrated embodiment, the interior space 114 of each of the bathrooms 108, 109 includes a passageway 118 providing access to the sink 115, the shower 116, and the toilet 117. In the illustrated embodiment, the passageway 118 extends from the entryway 113 of the bathroom 108, 109, between the sink 115 and the toilet 117, and to an entrance 119 of the shower 116 (e.g., one or more shower doors or a shower curtain). Additionally, in the illustrated embodiment, the sink 115 and the toilet 117 face each other (e.g., the sink 115 and the toilet 117 are aligned or substantially aligned with each other), although in one or more embodiments the sink 115 and the toilet 117 may be offset from each other. In the illustrated embodiment, the entryway 113 of the bathroom 108, 109 faces the entrance 119 of the shower 116 and the entrance 119 of the shower 116 is visible from the entryway 113 of the bathroom 108, 109. In one or more embodiments, the layouts of the bathrooms 108, 109 may be mirror images of each other (e.g., the layouts of the bathrooms 108, 109 may be mirror images of each other about an imaginary centerline of the vestibule 107).

In the illustrated embodiment, the hotel room 100 also includes a closet 120, 121 (e.g., a floor-to-ceiling closet) along the rear interior wall 111 of each of the bathrooms 108, 109, respectively. In the illustrated embodiment, each of the closets 120, 121 extends from one of the exterior sidewalls 103, 104, respectively, of the hotel room 100 toward the interior sidewall 112 of the bathroom 108, 109, respectively. In the illustrated embodiment, the closets 120, 121 terminate before the rear interior wall 111 of the bathrooms 108, 109, respectively (i.e., the closets 120, 121 are spaced apart from the interior sidewall 112 of the bathroom 108, 109, respectively), which is configured to improve or increase line-of-sight from the vestibule 107 to other parts of the hotel room 100, such as the common area 110 and the rear exterior wall 102. In one or more embodiments, the closets 120, 121 may extend along substantially the entire length of the rear interior wall 111 of the bathrooms 108, 109, respectively (e.g., the lengths of the closets 120, 121 may be equal or substantially equal to the length of the rear interior wall 111 of the bathrooms 108, 109, respectively). In one or more embodiments, the doorway 106, the closets 120, 121, and the entryways 113 to the bathrooms 108, 109 may have the same or substantially the same height.

In the illustrated embodiment, the hotel room 100 also includes a bed 122 in the common area 110. In the illustrated embodiment, the bed 122 is spaced apart from first and second exterior sidewalls 103, 104, the rear interior walls 111 of the bathrooms 108, 109, and the rear exterior wall 102 such that a pathway is defined in the common area 110 extending entirely around the bed 122. In one or more embodiments, the bed 122 may be laterally centered or substantially laterally centered in the common area 110 between the exterior sidewalls 103, 104. Additionally, in one or more embodiments, the bed 122 may be centered or substantially centered with respect to the vestibule 107 (e.g., a centerline of the bed 122 may be aligned or substantially aligned with a centerline of the vestibule 107). In one or more embodiments, the hotel room 100 may include only a single bed 122.

In the illustrated embodiment, the bed 122 includes a frame 123, a mattress 124 supported on the frame 123, and a headboard 125. Additionally, in the illustrated embodiment, the bed 122 is oriented such that a foot 126 of the bed 122 is proximate to the back exterior wall 102 and the headboard 125 is distal to the back exterior wall 102. In the illustrated embodiment, a front surface 127 of the headboard 125 faces the back exterior wall 102, and a back surface 128 of the headboard 125 faces the vestibule 107 and the doorway 106. Additionally, in the illustrated embodiment, the headboard 125 is wider than the vestibule 107 such that the headboard 125 extends past the interior sidewalls 112 of the bathrooms 108, 109. In the illustrated embodiment, the headboard 125 is parallel or substantially parallel to the rear interior walls 111 of the bathrooms 108, 109 and the front exterior wall 101 of the hotel room 100, and the headboard 125 is perpendicular or substantially perpendicular to the exterior sidewalls 103, 104 of the hotel room 100.

In the illustrated embodiment, the headboard 125 obscures or obstructs (e.g., completely or substantially completely obscures or obstructs) the view of the mattress 124 from the vestibule 107. Additionally, in the illustrated embodiment, the headboard 125 of the bed 122 partitions the common area 110 into a pathway between the headboard 125 and the rear interior walls 111 of the bathrooms 108, 109 that extends parallel or substantially parallel to the rear interior walls 111, and a pair of pathways on opposite sides of the bed 122 that extend parallel or substantially parallel to the exterior sidewalls 103, 104 of the hotel room 100.

In the illustrated embodiment, the hotel room 100 also includes a pair of end tables 129, 130 on opposite sides of the bed 122 proximate to the headboard 125. In the illustrated embodiment, each of the end tables 129, 130 is round (e.g., circular). In one or more embodiments, the end tables 129, 130 may have any other suitable shape (e.g., square or rectangular).

The hotel room 100 also includes a series of windows 131, 132, 133 in the rear exterior wall 102. In the illustrated embodiment, the hotel room 100 includes three windows (e.g., a center or central window 131 and a pair of peripheral windows 132, 133) in the rear exterior wall 102, although in one or more embodiments the rear exterior wall 102 may include any other suitable number of windows. Additionally, in the illustrated embodiment, the center window 132 is centered along the rear exterior wall 102 and is aligned with the vestibule 107 and a centerline of the bed 122. In the illustrated embodiment, the two peripheral windows 131, 133 are on opposite sides of the center window 132. In the illustrated embodiment, the configuration of the headboard 125 enables visibility of each of the windows 131, 132, 133 from the vestibule 107. For instance, in one or more embodiments, the height of the headboard 125 may be the same or substantially the same as the height of the window sill 134 of the center window 132 such that the headboard 125 does not obstruct the view of the center window 132 from the vestibule 107. In one or more embodiments, the height of the headboard 125 may be less than the height of the window sill 134 of the center window 132. Additionally, in one or more embodiments, upper corners 135, 136 of the headboard 125 may be rounded such that the headboard 125 does not obstruct the view of the two peripheral windows 131, 133 from the vestibule 107.

In the illustrated embodiment, the hotel room 100 also includes an armoire 137, 138 (e.g., a floor-to-ceiling armoire) along each of the exterior sidewalls 103, 104, respectively. In one or more embodiments, the armoires 137, 138 may be centered or substantially centered along the exterior sidewalls 103, 104, respectively, between the rear interior walls 111 of the bathrooms 108, 109, respectively, and the rear exterior wall 102 of the hotel room 100.

Additionally, in the illustrated embodiment, the hotel room 100 includes a built-in banquette seat 139, 140 along each of the exterior sidewalls 103, 104, respectively, between one of the armoires 137, 138, respectively, and one of the bathrooms 108, 109, respectively. In the illustrated embodiment, each of the built-in banquette seats 139, 140 includes a platform base 141, a seat 142 on the platform base 141, and a seat back 143 extending upward from the seat 142. Additionally, in the illustrated embodiment, each of the built-in banquette seats 139, 140 also includes a pair of armrests 144, 145 at opposite ends of the built-in banquette seat 139, 140. In the illustrated embodiment, the first armrest 144 of each of the built-in banquette seats 139, 140 abuts against the armoire 137, 138, respectively, positioned along one of the exterior sidewalls 103, 104, and the second armrest 145 of each of the built-in banquette seats 139, 140 abuts against the closet 120, 121, respectively, along the rear interior wall 111 of one of the bathrooms 108, 109, respectively. In one or more embodiments, an upper surface of the seat back 143 may be flush or substantially flush with upper surfaces of the armrests 144, 145 (e.g., the height of the seat back 143 may be the same as or substantially the same as the height of the armrests 144, 145).

In the illustrated embodiment, the hotel room 100 also includes a built-in corner banquette seat 146, 147 (i.e., a corner bench seat) in each of the rear corners of the hotel room 100 proximate to the rear exterior wall 102. In the illustrated embodiment, each of the built-in corner banquette seats 146, 147 includes a first segment or section 148 extending along one of the exterior sidewalls 103, 104, respectively, and a second segment or section 149 extending along the rear exterior wall 102 of the hotel room 100. Although in the illustrated embodiment the first and second sections 148, 149 are orthogonal or substantially orthogonal to each other, in one or more embodiments the first and second sections 148, 149 may be oriented at any other suitable angle with respect to each other, depending, for instance, on the configuration of the exterior walls 102, 103, 104 of the hotel room 100.

In the illustrated embodiment, each of the built-in corner banquette seats 146, 147 includes a platform base 150, a seat 151 on the platform base 150, and a seat back 152 extending upward from the seat 151. Additionally, in the illustrated embodiment, each of the built-in corner banquette seats 146, 147 includes a pair of armrests 153, 154 at opposite ends of the built-in corner banquette seat 146, 147 (e.g., each of the built-in corner banquette seats 146, 147 includes a first armrest 153 at an end of the first section 148 of the built-in corner banquette seat 146, 147 extending along one of the exterior sidewalls 103, 104, and a second armrest 154 at an end of the second section 149 of the built-in corner banquette seat 146, 147 extending along the rear exterior wall 102). In the illustrated embodiment, the first armrest 153 of each of the built-in corner banquette seats 146, 147 abuts against the armoire 137, 138, respectively, positioned along one of the exterior sidewalls 103, 104. In one or more embodiments, an upper surface of the seat back 152 may be flush or substantially flush with upper surfaces of the armrests 153, 154 (e.g., the height of the seat back 152 may be the same as or substantially the same as the height of the armrests 153, 154).

In the illustrated embodiment, the platform bases 141 of the built-in banquette seats 139, 140 are aligned or substantially aligned (e.g., flush or substantially flush) with the armoires 137, 138, respectively. Additionally, in the illustrated embodiment, the platform bases 150 of the first sections 148 of the built-in corner banquette seats 146, 147 aligned or substantially aligned (e.g., flush or substantially flush) with the armoires 137, 138, respectively.

In the illustrated embodiment, the hotel room 100 also includes a banquette table 155 along the rear exterior wall 102 between the built-in corner banquette seats 146, 147, and a pair of banquette table seats 156, 157 on opposite sides of the banquette table 155 facing the banquette table 155. In the illustrated embodiment, each of the banquette table seats 156, 157 includes a platform base 158, a seat 159 on the platform base 158, and a seat back 160 extending upward from the seat 159. Additionally, in the illustrated embodiment, each of the banquette table seats 156, 157 includes an armrest 161 extending upward from the platform base 158 and extending along the rear exterior wall 102 of the hotel room 100. In one or more embodiments, an upper surface of the seat back 160 may be flush or substantially flush with an upper surface of the armrest 161 (e.g., the height of the seat back 160 may be the same as or substantially the same as the height of the armrest 161). In the illustrated embodiment, the seat backs 160 of the banquette table seats 156, 157 abut against the second armrests 154 of the built-in corner banquette seat 146, 147.

In one or more embodiments, the height of the banquette table 155 may be the same or substantially the same as the height of the headboard 125 of the bed 122. Additionally, in one or more embodiments, the height of the banquette table 155 may be the same or substantially the same as the height of the armrests 153, 154, 161 and the seat backs 152, 160 of the built-in corner banquette seat 146, 147 and the banquette table seats 156, 157. Additionally, in one or more embodiments, the banquette table 155 may be aligned or substantially aligned with the window sill 134 of the center window 132 in the rear exterior wall 102 (e.g., the height of the banquette table 155 is the same or substantially the same as the height of the window sill 134 of the center window 132) such that the view of the center window 132 from the vestibule 107 is not obstructed or obscured by the banquette table 155. Additionally, in the illustrated embodiment, upper surfaces of the seat backs 152 of the built-in corner banquette seats 146, 147 are aligned or substantially aligned with the window sills 162 of the peripheral windows 131, 133 in the rear exterior wall 102 (e.g., the height seat backs 152 of the built-in corner banquette seats 146, 147 is the same or substantially the same as the height of the window sills 162 of the peripheral windows 131, 133) such that the view of the peripheral windows 131, 133 from the vestibule 107 is not obstructed or obscured by the built-in corner banquette seats 146, 147.

In one or more embodiments, the furniture and fixtures in the common area 110 (e.g., the closets 120, 121, the built-in banquette seats 139, 140, the armoires 137, 138, the built-in corner banquette seats 146, 147, the banquette table seats 156, 157, and the windows 131, 132, 133) may be symmetrical about a centerline of the vestibule 107.

In the illustrated embodiment, the height of the headboard 125 may be substantially equal to or less than the height of the window sills 134, 162, the banquette table 155, the banquette table seats 156, 157, and the built-in corner banquette seats 146, 147, which may make the windows 131, 132, 133, the table 155, the banquette table seats 156, 157, and the built-in corner banquette seats 146, 147 visible from the vestibule 107. Accordingly, in one or more embodiments, the symmetry of the furniture and/or fixtures in the common area 110 may be visible from the vestibule 107 (i.e., the view of the windows 131, 132, 133, the banquette table 155, the banquette table seats 156, 157, and the built-in corner banquette seats 146, 147 is not blocked or obscured by the headboard 125), which may provide the occupant with a sense of directional focus and flow to the hotel room 100. Additionally, in one or more embodiments, the height of the headboard 125, the banquette table 155, the banquette table seats 156, 157, and the built-in corner banquette seats 146, 147 may draw the occupant's gaze upward (e.g., the occupant's visual sight line may be drawn upward toward the windows 131, 132, 133 in the rear exterior wall 102 of the hotel room 100). Furthermore, the height of the headboard 125, the banquette table 155, the banquette table seats 156, 157, and the built-in corner banquette seats 146, 147, which draw the occupant's gaze upward, may improve the occupant's sense of balance. In contrast, in conventional hotel rooms in which the furniture and/or fixtures are at different heights, the occupant's gaze may be drawn downward, which may cause the occupant to take shorter steps that may lead to imbalance, particularly for elderly occupants or other individuals who are not surefooted.

In the illustrated embodiment, together, the closets 120, 121, the built-in banquette seats 139, 140, the armoires 137, 138, the built-in corner banquette seats 146, 147, the banquette table 155, and the banquette table seats 156, 157 extend continuously around the perimeter of the common area 110 except at the vestibule 107, which provides access into the common area 110.

In the illustrated embodiment, the hotel room 100 also includes a television 163. In the illustrated embodiment, the television 163 faces toward the foot 126 of the bed 122 and is aligned or substantially aligned with a centerline of the bed 122. Additionally, in the illustrated embodiment, the television 163 is centered or substantially centered along the rear exterior wall 102 of the hotel room 100 and the center window 132.

While this invention has been described in detail with particular references to exemplary embodiments thereof, the exemplary embodiments described herein are not intended to be exhaustive or to limit the scope of the invention to the exact forms disclosed. Moreover, although the invention is described herein for use as a hotel room, one of skill in the art would appreciate that the design features could be applied to other living spaces, for example, an apartment or other structure with living quarters. Furthermore, the design could be applied to any room having a vestibule, for example, a living room, a dining room, or even an office building. Persons skilled in the art and technology to which this invention pertains will appreciate that alterations and changes in the described structures can be practiced without meaningfully departing from the principles, spirit, and scope of this invention, as set forth in the following claims. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is component is referred to as being "coupled" to another component, it can be directly attached to the other component or intervening components may be present therebetween.

What is claimed is:

1. A hotel room comprising:

a plurality of exterior walls surrounding an interior space;

a doorway in a front exterior wall of the plurality of exterior walls;

a vestibule extending from the doorway into the interior space; and first and second bathrooms in the interior space directly along the vestibule and on opposite sides of the vestibule in the hotel room, wherein a layout of the first bathroom is the same as a layout of the second bathroom, wherein the doorway is centered along the front exterior wall, and wherein each of the first and second bathrooms comprises:

a rear interior wall;

an interior sidewall;

a space defined between the rear interior wall, the interior sidewall, a portion of the front exterior wall, and a portion of an exterior sidewall of the plurality of exterior walls;

a sink in the space and along the rear interior wall;

a toilet in the space and along the front exterior wall; and a shower in the space and along the exterior sidewall.

2. The hotel room of claim 1, wherein the layout of the first bathroom is a mirror of the layout of the second bathroom about a centerline of the vestibule.

3. The hotel room of claim 1, wherein each of the first and second bathrooms comprises an entryway in the interior sidewall, and wherein the entryway opens to the vestibule.

4. The hotel room of claim 1, further comprising a common area in the interior space, wherein the vestibule opens up into the common area.

5. The hotel room of claim 4, further comprising a bed in the common area.

6. A hotel room comprising:

a plurality of exterior walls surrounding an interior space;

a doorway in a front exterior wall of the plurality of exterior walls;

a vestibule extending from the doorway into the interior space;

first and second bathrooms in the interior space along the vestibule and on opposite sides of the vestibule in the hotel room;

a common area in the interior space; and a bed in the common area;

wherein the vestibule opens up into the common area, wherein a layout of the first bathroom is the same as a layout of the second bathroom, wherein the doorway is centered along the front exterior wall, and wherein the bed is laterally centered in the common area between a pair of opposing exterior sidewalls of the plurality of exterior walls.

7. The hotel room of claim 6, wherein the bed comprises a frame and a headboard, and wherein a back surface of the headboard faces the vestibule.

8. The hotel room of claim 7, further comprising a plurality of windows in a rear exterior wall of the plurality of exterior walls, wherein a height of the headboard is substantially equal to a height of a window sill of a central window of the plurality of windows.

9. The hotel room of claim 7, wherein the headboard comprises a pair of notches.

10. The hotel room of claim 9, further comprising a pair of nightstands coupled to the headboard below the pair of notches.

11. The hotel room of claim 10, wherein the pair of nightstands are supported by the headboard above a floor of the hotel room.

12. The hotel room of claim 10, further comprising:

a first built-in corner banquette seat in a first corner of the common area proximate to a rear exterior wall of the plurality of exterior walls opposite the front exterior wall; and a second built-in corner banquette seat in a second corner of the common area proximate to the rear exterior wall.

13. The hotel room of claim 12, further comprising:

a first closet along a rear interior wall of the first bathroom;

a second closet along a rear interior wall of the second bathroom;

a first armoire along a first exterior sidewall of the plurality of exterior walls; and a second armoire along a second exterior sidewall of the plurality of exterior walls opposite the first exterior sidewall.

14. The hotel room of claim 13, further comprising:

a first built-in banquette seat extending along the first exterior sidewall between the first armoire and the first closet; and a second built-in banquette seat extending along the second exterior sidewall between the second armoire and the second closet.

15. The hotel room of claim 12, further comprising:

a banquette table along the rear exterior wall between the first and second built-in corner banquette seats; and a pair of banquette table seats facing the banquette table.

16. A hotel room comprising:

a plurality of exterior walls surrounding an interior space;

a doorway in a front exterior wall of the plurality of exterior walls;

a vestibule extending from the doorway into the interior space;

first and second bathrooms in the interior space along the vestibule and on opposite sides of the vestibule in the hotel room;

a common area at an end of the vestibule;

a single bed comprising a frame and a headboard in the common area, a rear surface of the headboard facing the vestibule; and a plurality of windows in a rear exterior wall of the plurality of exterior walls.

17. The hotel room of claim 16, further comprising:

first and second closets along rear interior walls of the first and second bathrooms;

first and second armoires along first and second exterior sidewalls of the plurality of exterior walls;

first and second built-in banquette seats extending along the first and second exterior sidewalls between a respective one of the first and second armoires and a respective one of the first and second closets;

first and second built-in corner banquette seats in first and second corners of the common area proximate to a rear exterior wall of the plurality of exterior walls opposite the front exterior wall;

a banquette table along the rear exterior wall between the first and second built-in corner banquette seats; and first and second banquette table seats facing the banquette table.

18. The hotel room of claim 17, wherein the first and second closets, the first and second armoires, the first and second built-in banquette seats, the first and second built-in corner banquette seats, the banquette table, and first and second banquette table seats together extend continuously around a perimeter of the common area except at the vestibule.

19. The hotel room of claim 16, wherein a layout of the first bathroom is the same as a layout of the second bathroom, and wherein the doorway is centered along the front exterior wall.

* * * * *